US006439941B2

(12) United States Patent
McClure et al.

(10) Patent No.: US 6,439,941 B2
(45) Date of Patent: Aug. 27, 2002

(54) AUTOMATED FAIL-SAFE SEA RESCUE FLOTATION SYSTEM

(76) Inventors: Richard J. McClure, 4981 September St., San Diego, CA (US) 92119; Esther S. Massengill; R. Kemp Massengill, both of 664 Hymetus Ave., Leucadia, CA (US) 92024

( * ) Notice: Subject to any disclaimer, the term of this patent is extended or adjusted under 35 U.S.C. 154(b) by 0 days.

(21) Appl. No.: 09/828,285

(22) Filed: Apr. 5, 2001

Related U.S. Application Data

(60) Provisional application No. 60/165,487, filed on Nov. 15, 1999.

(51) Int. Cl.[7] ..... B63C 9/08
(52) U.S. Cl. ..... 441/89
(58) Field of Search ..... 441/88, 89, 10, 441/97; 342/357.06–357.1

(56) References Cited

U.S. PATENT DOCUMENTS

| | | | | | |
|---|---|---|---|---|---|
| 4,725,253 | A | * | 2/1988 | Politte | 441/130 |
| 5,408,238 | A | * | 4/1995 | Smith | 342/357 |
| 5,461,365 | A | | 10/1995 | Schlager et al. | |
| 5,650,770 | A | | 7/1997 | Schlager et al. | |
| 5,963,130 | A | | 10/1999 | Schager et al. | |
| 6,222,484 | B1 | * | 4/2001 | Seiple et al. | 342/357.09 |

OTHER PUBLICATIONS

BearCom Wireless Communications; Iridium Product Advertisement; Jun. 15, 1999; 9 pages.

Compton, Jason; *Put Your Business on the Map*; PC Computing; pp. 90–106; Apr. 2000.

*FYEye*; Forbes; Nov. 15, 1999; p. 30.

Hammacher Schlemmer Operations Center Catalogue; Wristwatch GPS Navigator; Product No. 75009L; Sep., 1999; 1 page.

Iridium for Maritime Communication; Product Advertisement; Jun. 15, 1999; 5 pages.

Landfall Navigation; Alert System Product Advertisement; Oct. 7, 1999; 1 page.

McDonald, Jeff; *Clinton Boosts Public's Access to GPS*; The San Diego Union–Tribune; May 2, 2000; p. A–1.

Motorola Cellular Service, Inc.; Iridium Service Product Advertisement, Date unknown; 2 pages.

San Diego Union–Tribune; *Introducing Sportbrain*Product Advertisement; Dec. 22, 2000; 2 pages.

*"Smart Shirt" Can Save Lives on the Battlefield*; Telemedicine and Virtual Reality; May, 1998; p. 51.

* cited by examiner

*Primary Examiner*—Ed Swinehart
(74) *Attorney, Agent, or Firm*—Gerald W. Spinks

(57) ABSTRACT

A sea rescue signaling system including a personal flotation device equipped with a GPS receiver, a satellite radio-telephone, a hydrostatic pressure detector, and a controller. When the pressure detector senses a minimum specified submersion of the device for a minimum specified duration, the controller energizes the GPS and the radio-telephone, then dials a rescue service and transmits a distress signal and position data.

20 Claims, 1 Drawing Sheet

AUTOMATED FAIL-SAFE SEA RESCUE FLOTATION SYSTEM

CROSS REFERENCE TO RELATED APPLICATIONS

This application claims priority from U.S. Provisional Patent Application Ser. No. 60/165,487, filed on Nov. 15, 1999, and entitled "Automated Fail-Safe Sea Rescue Flotation System", the disclosure of which is incorporated herein by reference.

STATEMENT REGARDING FEDERALLY SPONSORED RESEARCH OR DEVELOPMENT

Not Applicable

BACKGROUND OF THE INVENTION

1. Field of the Invention

This invention is in the field of personal flotation devices used to preserve the lives of persons going overboard from a watercraft, or going overboard during the sinking of a watercraft.

2. Background Art

Lives are unnecessarily lost at sea every year because of the inability of would-be rescuers to locate in a timely fashion an overboard person in distress. As three days is the generally-accepted physical limit for a human body to do without potable water, time is of the essence not only in locating, but also in actually rescuing, a person adrift in open waters. In busy waterways, time is even more of the essence, as the potential for inadvertent rundown is ever-present.

In some situations, a boat can suddenly and inexplicably sink without warning. The boaters may have just enough time to don life vests before being plunged into the water. Even when other boats are in the area, and even if those boats are looking for the people in the water, weather and sea conditions can make the victims' exact locations difficult to determine, and prevent a timely rescue.

Currently, search teams may be aided in rescue missions of a person missing at sea by the distressed individual's use of mirrors, flashlights, flares, whistles, and dye markers. These are sometimes ineffective, with the result that the distressed person drowns.

Military personnel are sometimes equipped with a radio-beacon homing device, but this is generally simply providing a homing target, and not transmitting location data. The typical homing device follows the inverse square law of physics, as the signal decreases in amplitude in proportion to the distance from the beacon to the would-be rescuer. As a result, if a signal for rescue were to be transmitted from a great distance, a substantially large power transmission system is required, as well as a high antenna, for the transmission to be effective.

Some boaters utilize a sea rescue system consisting of a water-activated strobe and a howling signal aboard the boat, to alert crew members on the boat of a "man overboard," as well as an automatic boat engine shutdown and a Global Positioning System (GPS) location marker. This type of system may not be helpful when the boat sinks, or when there are no able-bodied personnel remaining on the boat.

A system disclosed in U.S. Pat. No. 5,650,770 to Schlager, et al., "Self-Locating Remote Monitoring Systems," discloses an embodiment incorporating a GPS system, but this system requires an "electronic handshake" and repetitive polling between a base station on the boat and each remote unit (i.e., the life vest of the person overboard). In other words, distress signals from a source, such as the survivors of a boat which has sunk 20 miles off the coast, would not be picked up by an unrelated rescue station on land. In fact, no communication with a land station is disclosed. Additionally, the Schlager et al. system does not signal distress until the remote unit, representing the victim in distress, has traveled beyond a predetermined distance from the base station, thus triggering the base station to instruct the remote unit to initiate distress signaling from the victim to the base station (typically, the boat in a man-overboard situation). Continuous polling of the remote unit by the base station repetitively measures the distance between the base station and the remote unit, to determine whether an alarm condition exists, and to instruct the remote unit to initiate distress signaling. The electronic handshake prevents false alarm signaling, but it requires an extra piece of equipment to render the system operable, and it makes the system dependent upon a minimum separation distance between the remote unit and the base station. In summary, the electronic handshake in the Schlager system may work very well between a boat and the life vest worn by a man overboard, but, if the boat has sunk, the system breaks down and a long-distance open-sea rescue mission will not be summoned.

The Schlager et al. system not only has the absolute necessity for an electronic handshake, but also a limitation on distress signaling only when the victim is farther away from the base station than a predetermined distance. The Schlager system, therefore, can not be adapted to provide distress signaling and position notification from a remote unit directly to an unrelated rescue station at some distance, such as a Coast Guard station.

It would be desirable to have a self-contained sea rescue signaling unit utilizing a GPS receiver incorporated into an automated and "fail-safe" personal flotation life-preserver rescue system, capable of sensing a true man-overboard situation on its own, and capable of sending a distress signal and reliable position data to an unrelated rescue station, even at a great distance.

BRIEF SUMMARY OF THE INVENTION

In the present invention, a personal flotation device (PFD) is provided with a hydrostatic pressure sensor, a Global Positioning System (GPS) receiver, a satellite radio-telephone, and a controller. When the hydrostatic pressure sensor is submerged to a sufficient depth for a sufficient duration to indicate a true man-overboard situation, the controller energizes the GPS receiver to accurately determine the position coordinates of the device. Further, the controller energizes the satellite radio-telephone to transmit a distress signal and accurate position coordinates to a remote rescue station, such as a Coast Guard facility, via a satellite telephone system. The controller periodically de-energizes the satellite radio-telephone to conserve battery power, periodically powering up to repetitively transmit the distress and position signals. Further, if the hydrostatic pressure sensor indicates that the device has been removed from the water, the controller ceases transmission. An input device can also be incorporated, such as a keyboard or microphone, to allow the victim to control operation of the device or to transmit voice or data signals.

The present invention has no restrictions on where, or at what distance, distress signaling begins. Whether the distress signaling emanates from a victim adrift at sea one mile from land, or 1,000 miles from land; or whether or not the victim is within a predetermined distance from a boat; are of no importance in triggering distress signaling and location-pinpointing signaling. With the present invention, anytime whatsoever that a victim is adrift in water, regardless of the distance from a boat or other receiver, the sea-rescue life vest, after meeting fail-safe requirements as delineated below, automatically begins distress signaling and position-location signaling. Additionally, the present invention has no need for a base station, and no requirement for an "electronic handshake" to be in place.

The present invention provides:

1. a fool-proof means for automated distress signaling and location pinpointing for people adrift and in need of rescue anywhere in open waters; and,
2. a fail-safe system which prevents false alarms.

The present invention provides both of these functions with a relatively low power requirement, and a cumbersome antenna is not required, as the effect of a very high antenna is achieved by transmitting the distress and position signals via orbiting satellites.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1A:
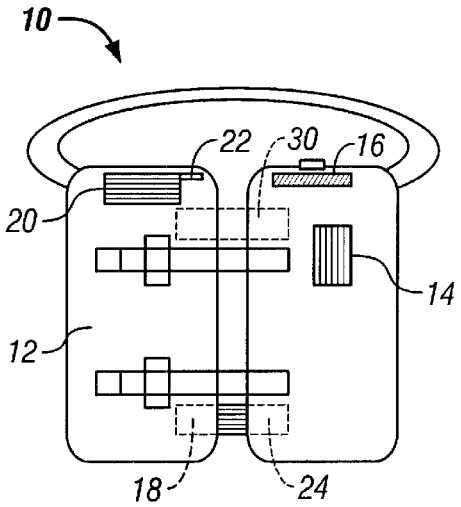
FIG. 1A is a front elevation view of a personal flotation device according to the present invention.
Figure 1B:
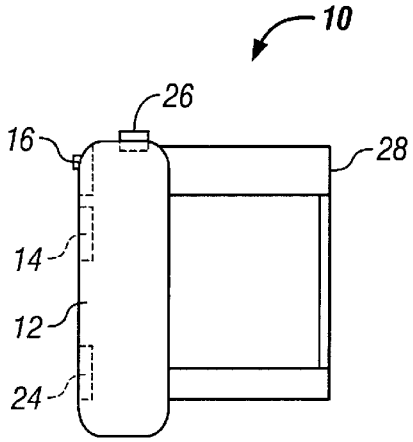
FIG. 1B is a side elevation view of the PFD shown in FIG. 1A.

FIGS. 1A and 1B show front and side views, respectively, of a proposed rescue apparatus 10 according to the present invention, including a personal flotation device (PFD) vest 12. FIG. 1A shows the front of the PFD 12, with a satellite radio-telephone 14 installed in the upper body region, a transmission antenna 16 for same located at the top of the vest 12, and an immersion sensor 18 in the lower aspect of the vest 12. A Global Positioning System (GPS) receiver 20 and antenna 22 system is also shown on the top front area on the opposite side of the vest 12 from the satellite radio-telephone system 14. A battery pack 24 with a battery life surface display is located on the lower front area, and an optional microphone/speaker 26 is located on the top front edge of the flotation vest 12. A waterproofed wire harness 28 interconnects the various elements of the system 10, passing from one side of the flotation vest 12 to the other side via the interconnecting back portion, as shown in FIG. 1B. All elements are appropriately waterproofed.

Figure 2:
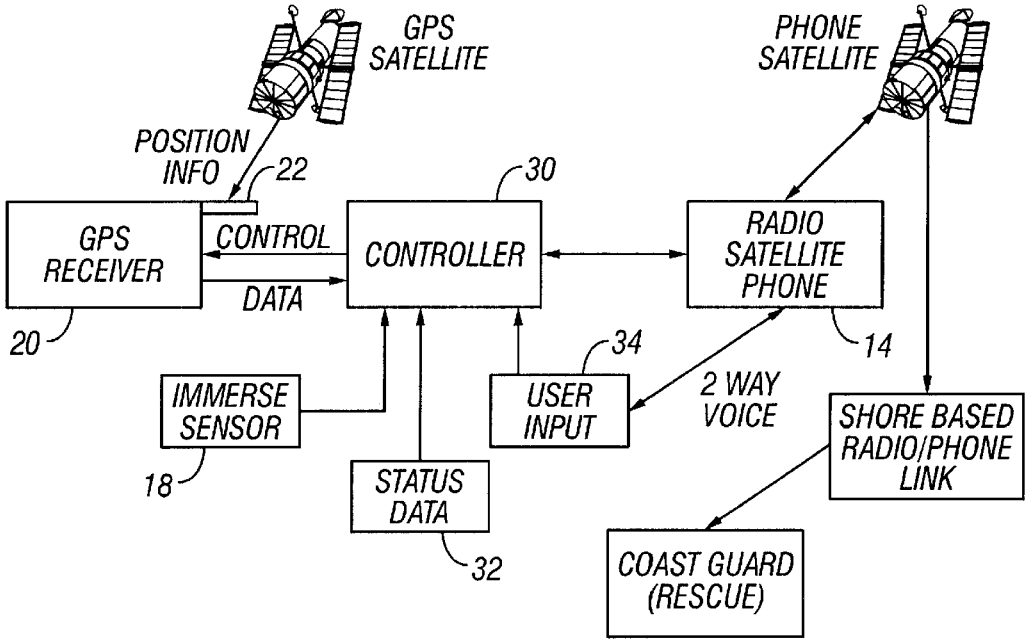
FIG. 2 is a schematic diagram of the system of the present invention.

FIG. 2 shows, in schematic block diagram form, a GPS receiver 20 connected to a controller 30, which in turn is connected to a satellite radio-telephone 14. Input is shown to the controller 30 from an immersion sensor 18. Additionally, input is also shown from an optional victim status data module 32, and from an optional user input module 34, such as a keyboard-type device. FIG. 2 also shows a pathway between the optional user input module 34 and the satellite radio-telephone 14, which may embody optional two-way voice communication capability.

The preferred embodiment of the present invention is completely waterproof, as opposed to being merely water-resistant. As it is contemplated that a distressed person could be adrift and alive for potentially as long as three days, geopositioning data acquisition and distress-signal transmission must function for at least a three-day period. A closed-cell, radiotransparent plastic structural encasing around each component achieves this waterproofing. Encasing the electronics of the present invention to achieve true waterproofing includes heat sealed radiotransparent molded plastic, although, alternatively, molded closed cell Styrofoam, or even "bubble packs," could serve the need. Other means for achieving the required waterproofing, as known to the field of art for underwater electronics systems, can also be provided.

The present invention is automatically activated, a very important feature, as, oftentimes, when a boat sinks, a person cast adrift at sea is rendered unconscious either from contact with water if thrown from a height, or from a blow by an errant part of the boat or ship, such as a beam or mainsail. Even if the boat does not sink, a person overboard is, nevertheless, often unconscious. Thus, distress signaling and location-pinpointing transmissions must commence automatically.

The presently proposed automated flotation device rescue system is "water-activated." A life-preserver rescue system which is water activated, however, carries the potential for a great number of "false positives," as a result of which an expensive rescue mission could be carelessly and needlessly initiated simply by having a water-activated system slip overboard or be thrown overboard by pranksters. Thus, the present invention incorporates a "fail-safe" feature; namely, the controller 30 must enter a second stage before distress and autolocator signaling is actually initiated.

The preferred embodiment 10 of the present invention incorporates an automated two-stage fail-safe activation system in order to minimize the potential for false alarms. This two-stage water activation phase, which turns on power to the electrical components, is then followed by a second phase which includes the acquisition of GPS data, and distress and position-location signaling.

When placed in the water, the automated rescue flotation device 10 is activated to a "power-on" state during a first phase, via a hydrostatic sensor 18 which recognizes a minimum specified hydrostatic pressure, such as six inches of water, for a minimum specified duration of immersion, such as 30 seconds. Detection of the minimum immersion depth, Stage One, and measurement of the minimum immersion duration, Stage Two, can be accomplished either in the hydrostatic sensor 18 itself, or in the associated controller 30. Simply wetting the automated life vest 10, such as by a hose during boat washdown, does not achieve the required level of hydrostatic pressure for Stage One to be satisfied for power-on activation. It should be emphasized that the water-activated immersion sensor 18 is not a "blotter-type" sensor, as, with such a sensor, many false alarms would be triggered simply by having the life vest thrown overboard or become inadvertently wetted.

The immersion sensor 18 is located in the lower portion of the automated flotation vest 12, i.e., toward the waist, rather than the neck, and is, therefore, continuously submerged to at least the required depth, Stage One, when the life vest 12 is appropriately worn by a person in water, thus automatically activating a power-on state after a required duration of immersion, Stage Two. On the other hand, when the life vest 12 is not worn, but, rather, inadvertently falls overboard, the immersion sensor 18 does not achieve sufficient water depth, Stage One, to activate power, as the life vest 12 and its built-in sensor 18 float well above the 6-inch depth required to achieve the minimum hydrostatic pressure for Stage One of the power activation phase.

Once the defined depth of water immersion, Stage One, has occurred for a defined quantity of time, Stage Two, as, for instance, 30 seconds, the data acquisition and data transmission system becomes automatically activated in a second phase.

As an additional safeguard, to preclude false-alarm-triggered rescue searches, which can be expensive and labor-intensive, the proposed invention's continued signal transmission is dependent upon continuous water immersion. This further guards against initiation of unnecessary rescue missions, such as if someone briefly falls overboard and is then rescued in a short period of time by personnel on the boat. In the case of such a rescue, personnel on the boat should be able to inform the Coast Guard, for instance, that a rescue mission is no longer required. So, the PFD 12 of the present invention can be used in a "man-overboard" situation in which the rescue can be directly carried out by the boat from which a person is swept overboard. The present invention 10 also functions well, however, in the situation where the boat has sunk, or where the victim is left behind in the water.

Even if, during a storm or heavy seas, a wave washes over the vest 10, momentarily submerging it to the required depth for Stage One of the "power-on" phase, the time of immersion will be insufficient to satisfy Stage Two of the power-on phase, thereby preventing initiation of the second phase of the process, distress signaling and position-location signaling. Further, even if the life vest 10 accidentally slips overboard in an unoccupied state in rough seas, where waters wash frequently over the vest 10 and submerge it to the required depth, with the possibility of triggering the hydrostatic immersion sensor 18 and thereby satisfying Stage One, such immersion to at least the required depth is not anticipated to be of sufficient duration (i.e., for instance, 30 seconds) to allow satisfaction of Stage Two, thereby preventing distress and position-location signaling transmission.

Thus, the present invention requires water immersion of the flotation life jacket 12 to at least the depth required to achieve a specific hydrostatic water pressure, i.e., Stage One, and, subsequently, maintenance of at least this depth for a defined period of time, such as for 30 seconds, i.e., Stage Two, thus activating power to the electrical components, after which the second phase of automated geopositioning data acquisition and distress/location-pinpointing signal transmission commences. Further, after satisfaction of the initial 30-second hydrostatic immersion requirement, then, immersion must be continuous to at least the predetermined water depth for Phase Two transmissions to continue. If, for instance, the hydrostatic sensor 18 comes out of the water, transmission ceases, as, for instance, if someone fell overboard and were then promptly rescued. This feature helps to prevent the continuation of unnecessary and unwarranted rescue distress signals.

Providing a two-stage "fail-safe" procedural strategy for signaling that a rescue mission is needed obviates carelessly, or inadvertently, triggered false-alarm rescues, such as might occur in a singularly-activated distress-signaling mechanism if someone were to engage in horseplay and to throw the device 10 overboard, i.e., an automated flotation device system with only a single activation system to allow distress signaling.

To summarize, the sequence for Phase One power-on has two elements:

1. Stage One—water immersion to at least a specific depth to achieve the required hydrostatic pressure at the immersion sensor 18; and
2. Stage Two—maintenance of continuous water immersion and a minimum hydrostatic pressure for a defined period of time.

Phase One is followed by Phase Two, which also has two elements:

1. GPS acquisition of accurate position coordinates; and
2. Continuous distress and position-location transmission to a rescue service.

Continued water immersion to at least the minimum depth to achieve the required hydrostatic pressure is subsequently necessary to perpetuate distress signaling and position-location signaling. Such continuous water immersion to at least a specific depth sufficient to achieve the hydrostatic pressure necessary for triggering Phase One power-on activation and maintaining Phase Two signal transmission can only be achieved when someone is actually wearing the life vest 12.

It should be emphasized that the proposed automated flotation device rescue system 10 is not suitable for intentional submersion uses, such as for water-skiing, where participants frequently lose balance and become at least partially submerged. Further, larger bodies of water, such as the Great Lakes, which, especially during seasonal storms, simulate a deep-ocean environment, present the ideal utilization of the proposed invention 10. On the other hand, even at a distance of no more than one or two miles offshore in a large body of water, conditions are often so adverse for survival (sharks, cold water, currents, dismal prospect of swimming safely to shore, etc.) that the present invention 10 becomes invaluable for successful rescue efforts. At-sea, then, is the optimal environment for the present invention.

Certainly, a false alarm rescue mission could well be unduly expensive, especially if the distress signal is emitted from a distant off-shore locus. Additionally, the occurrence of frequent false alarms is demoralizing to would-be rescue teams. Long-distance oceanic rescue missions, therefore, must not be initiated on a casual or on a willy-nilly basis.

Described above is a two-stage system which greatly lessens the chance of a false alarm; namely, Stage One, a minimum water-immersion hydrostatic pressure prerequisite; and, Stage Two, a minimum duration continuous water-immersion prerequisite; to commence and, to maintain, signal transmission. Unless the PFD 12 is actually worn by a person, then, the specified hydrostatic pressure required for triggering Stage One is not achieved, as the PFD 12 floats with only a one to three inch water draft, and this is insufficient hydrostatic pressure to trigger a response of the immersion sensor 18.

In the preferred embodiment, the personal flotation device 12 is in a vest configuration. The vest buoyancy is such that the water-activated sensor 18 is not under water to the predesignated setting, Stage One, such as 6 inches, unless the vest 12 is worn by someone weighing at least 25 pounds. In other words, the vest 12 must be worn by a human being before the hydrostatic immersion sensor 18 becomes submerged to at least the required depth to activate Stage One and enable turning the power on. It is, therefore, important that the hydrostatic immersion sensor 18 be placed in a location on the life vest 12 such that it becomes, and remains, submerged to the required depth only when being worn by a person.

To make absolutely certain that a child's life vest becomes properly activated, it is possible to have an immersion sensor 18 set at a slightly lower depth, such as four inches, as contrasted to the previously discussed six inch immersion requirement for an adult life vest.

The preferred embodiment calls for the hydrostatic immersion sensor 18 to be placed in the lower frontal area of the life vest 12, such as in direct relation to the lower chest/upper abdominal portion of the life vest 12. Such placement ensures that the immersion sensor 18 does, in fact, sink to a sufficient depth to achieve a sufficient hydrostatic pressure to trigger activation, when properly worn. If, on the other hand, the immersion sensor 18 were to be positioned at the top, or toward the top, of the life vest 12, it is possible that sufficient hydrostatic sensor immersion and subsequent power activation would not occur, with potentially disastrous consequences.

There is good reason for placing emphasis upon the elimination of false alarms. A five-mile rescue off the coast may cost only an amount which is not insurmountable to a boater, even if ultimately this fee is charged to the rescued individual, either directly or through "rescue insurance." Contrastingly, however, distant open-water rescues involving airplanes, helicopters, or airplane-guided rescue boats, could easily mount huge expenses, which would certainly be onerous for a false alarm. The present invention, then, is made as foolproof as possible.

New long-acting batteries preclude the need for frequent battery recharging of the proposed invention. For instance, a high-powered lithium battery pack 24 retains sufficient charge for proper operation of the automated flotation device 10 for upwards of two years before replacement is required.

A battery-power indicator display (not shown) is provided to test battery life, and, as a further safeguard, a tamper-proof date dial (not shown) is also provided, with a day/month/year readout for dialing in the date of new battery pack insertion. Additionally, prominent colored lettering, reminding the owner to replace the battery, is provided. An example of a conspicuous and easily-read color combination is green letters on an orange background.

It is strongly advised that the battery pack 24 be replaced on at least a yearly basis, as a built-in safety margin of two to one, or three to one, is thereby incorporated, in that the useful life of the invention's battery pack 24 is at least two to three years.

The date dial (not shown) requires tamper-proof operation, such as a key, or a code, as this prevents someone, such as a child or a teenage prankster, from changing the date. For instance, the date can be changed on the date dial only upon the insertion of a key and the rotation of said key into the "change" mode.

Efficiency is achieved by having a single key to both provide access to the date dial and open the battery-pack compartment. When this compartment is opened with the appropriate key, the date dial is released to allow resetting.

A duty cycle of the electrical components is employed during Phase Two, to lengthen the duration of transmission capability, to conserve power, and to delay battery failure. Intermittent transmissions must be able to be maintained for at least the estimated life expectancy of a person adrift at sea, which is three days. Transmission over a 4-day period would give added security. The duty cycle must be compatible with the satellite radio-telephone system 14 of the present invention and, therefore, must allow for acquisition time for GPS reception, and for subsequent distress/position-location signaling. The present invention, by providing features such as a suitable duty cycle and radio transmission to a nearby orbiting satellite, thereby conserves power, with the result that there is less need for a bulky high-power battery system. In essence, the present invention, then, is a relatively low-power system.

A typical Phase Two duty cycle may be as follows:

1. GPS acquisition begins as soon as possible after Stage Two has been achieved.
2. Position data from GPS 20 is received by the Controller 30.
3. The Controller 30 shuts down the GPS 20.
4. The Controller 30 turns on the satellite radio-telephone 14 and dials a pre-selected number, such as a Coast Guard station.
5. The Controller 30 commands transmission of a distress signal and GPS position data to the Coast Guard (or rescue service) for the needed duration and shuts down the satellite radio-telephone 14.
6. The Controller 30 repeats Steps 4 and 5 every hour (or less), and Steps 1 through 5 every six hours (or less). Thus, via the Controller 30 appropriately turning off the power-hungry GPS 20 and satellite radio-telephone 14 systems when not needed, power is greatly conserved.

Omni-directional GPS and satellite radio-telephone transmission antennae 22, 16 face the sky when the vest 12 is worn. The preferred embodiment places the GPS and satellite radio-telephone antennae 22, 16 in a horizontal place in the upper, frontal chest area of the life vest 12, such that these antennae 22, 16 face the sky when the vest 12 is worn. For instance, the GPS antenna 22 could be horizontally secured in the life vest 12 adjacent and parallel to the left collarbone, and the satellite radio-telephone antenna 16 could be horizontally secured in the life vest 12 adjacent and parallel to the right collarbone.

An identifying life vest code number, registered with the Coast Guard or other appropriate agency, can be included in the transmitted signal, as an additional safeguard to pinpoint who is wearing the life vest 12, or, most practically, with which boat the life vest 12 is associated. Certainly, if a long-distance trip is planned, the Coast Guard could be notified in advance of the route to be taken, but, unlike the Schlager system, no "electronic handshake," with maintenance of signaling, is required. In contrast, the present invention is powered-off and not in a data acquisition or transmission mode, until, and unless, a victim is overboard and Stage One and Stage Two prerequisites have been satisfied.

A "sea-rescue" insurance policy also could be made available. In the event of an actual open water rescue, a reduction in co-payment, or even a waiver of co-payment, could be applicable for boat trips for which time-frame, route, and destination were previously registered with the United States Coast Guard, or with other appropriate international, or local, agencies.

Upon receipt of a signal from the immersion sensor 18 that the predetermined required hydrostatic pressure has been achieved, the Controller 30 establishes that Stage One has been satisfied. After the predetermined time delay, such as, for instance, 30 seconds, the Controller 30 establishes satisfaction of Stage Two, powers on the GPS receiver 20, and waits to receive triangulated position data from the GPS receiver 20. If still in Stage Two at this time, the Controller 30 activates the satellite radio-telephone 14 and dials a pre-programmed shore-based rescue station number. When contact is established, the Controller 30 commands transmission of the distress signal and the position data. This may be followed by transmission of optional input, such as status and user input, which could include keyboard and/or voice communication. Then, after a predetermined interval, the Controller 30 shuts down the satellite radio-telephone 14 to conserve power. The transmission process may be repeated at suitable intervals, such as one per hour (or less), and, at suitable intervals, the Controller 30 also obtains updated data from the GPS receiver 20 for subsequent transmissions.

An example of an available satellite radio-telephone system 14 as described in the present invention is the Motorola Iridium system. In addition to automatic distress signaling and location pinpointing signaling, the present invention can provide two-way communication for voice, as well as encoded survivor status. Additional battery power, or even a separate long-acting battery pack, may be provided. Appropriate waterproofing of the elements of the entire system is included.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A sea rescue apparatus, comprising:

a personal flotation device (PFD);

a hydrostatic pressure sensor mounted on said PFD;

a global positioning system (GPS) receiver mounted on said PFD;

a radio transmitter mounted on said PFD; and a controller connected to said hydrostatic pressure sensor, said GPS receiver, and said radio transmitter;

wherein said controller is programmed to transmit location data via said radio transmitter only when said controller detects a hydrostatic pressure signal having at least a selected magnitude for at least a selected duration.

2. The apparatus recited in claim 1, wherein the location of said hydrostatic pressure sensor on said PFD is selected to cause said hydrostatic pressure sensor to sink to a selected depth, producing a hydrostatic pressure signal having said selected magnitude, when said PFD is floating in water and supporting a selected minimum weight.

3. The apparatus recited in claim 1, wherein said radio transmitter is adapted to communicate via a satellite radio-telephone transmission system.

4. The apparatus recited in claim 1, wherein said controller is further programmed to transmit a distress signal via said radio transmitter when said controller detects a hydrostatic pressure signal having at least a selected magnitude for at least a selected duration.

5. The apparatus recited in claim 1, wherein said controller is further programmed to energize said GPS receiver and said radio transmitter when said controller detects a hydrostatic pressure signal having at least a selected magnitude for at least a selected duration.

6. The apparatus recited in claim 5, wherein said controller is further programmed to periodically de-energize said radio transmitter to conserve power.

7. The apparatus recited in claim 1, wherein said controller is further programmed to cease transmission when said controller detects a hydrostatic pressure signal having less than said selected magnitude.

8. The apparatus recited in claim 1, wherein said controller is further programmed to transmit a unique identification code.

9. The apparatus recited in claim 1, further comprising a user input module mounted on said PFD.

10. The apparatus recited in claim 9, wherein said user input module further comprises a microphone.

11. The apparatus recited in claim 9, wherein said user input module further comprises a keyboard.

12. A sea rescue apparatus, comprising:

a personal flotation device (PFD);

a hydrostatic pressure sensor mounted on said PFD at a location selected to cause said hydrostatic pressure sensor to sink to a selected depth, producing a hydrostatic pressure signal having a selected magnitude, when said PFD is floating in water and supporting a selected minimum weight;

a global positioning system (GPS) receiver mounted on said PFD;

a radio transmitter mounted on said PFD; and a controller connected to said hydrostatic pressure sensor, said GPS receiver, and said radio transmitter;

wherein said controller is programmed to energize said GPS receiver and said radio transmitter, and to transmit a distress signal and location data via said radio transmitter, only when said controller detects a hydrostatic pressure signal having at least said selected magnitude for at least a selected duration.

13. The apparatus recited in claim 12, wherein said radio transmitter is adapted to communicate via a satellite radio-telephone transmission system.

14. The apparatus recited in claim 12, wherein said controller is further programmed to cease transmission when said controller detects a hydrostatic pressure signal having less than said selected magnitude.

15. The apparatus recited in claim 12, wherein said controller is further programmed to transmit a unique identification code.

16. The apparatus recited in claim 12, further comprising a user input module mounted on said PFD.

17. A sea rescue apparatus, comprising:

a personal flotation device (PFD);

a hydrostatic pressure sensor mounted on said PFD at a location selected to cause said hydrostatic pressure sensor to sink to a selected depth, producing a hydrostatic pressure signal having a selected magnitude, when said PFD is floating in water and supporting a selected minimum weight;

a global positioning system (GPS) receiver mounted on said PFD;

a radio satellite transmitter mounted on said PFD; and a controller connected to said hydrostatic pressure sensor, said GPS receiver, and said radio transmitter;

wherein said controller is programmed to energize said GPS receiver and said radio transmitter, and to transmit a distress signal and location data via said radio transmitter, when said controller detects a hydrostatic pressure signal having at least said selected magnitude for at least a selected duration, and to cease transmission when said controller detects a hydrostatic pressure signal having less than said selected magnitude.

18. A sea rescue method, comprising:

providing a personal flotation device (PFD) having a hydrostatic pressure sensor, a global positioning system (GPS) receiver, a radio transmitter, and a controller;

submerging said hydrostatic pressure sensor to at least a selected depth, producing a hydrostatic pressure signal having at least a selected magnitude, when said PFD is floating in water and supporting a selected minimum weight;

energizing said GPS receiver and said radio transmitter with said controller when said hydrostatic pressure signal reaches said selected magnitude for a selected duration; and transmitting a distress signal and location data via said radio transmitter.

19. The method recited in claim 18, further comprising ceasing said transmission when said controller detects a hydrostatic pressure signal having less than said selected magnitude.

20. The method recited in claim 18, further comprising transmitting a unique identification code via said radio transmitter.

* * * * *